US005414433A

United States Patent [19]

Chang

[11] Patent Number: 5,414,433

[45] Date of Patent: May 9, 1995

[54] PHASED ARRAY RADAR ANTENNA WITH TWO-STAGE TIME DELAY UNITS

[75] Inventor: Kaichiang Chang, Northborough, Mass.

[73] Assignee: Raytheon Company, Lexington, Mass.

[21] Appl. No.: 197,041

[22] Filed: Feb. 16, 1994

[51] Int. Cl.[6] ..... H01Q 3/22

[52] U.S. Cl. ..... 342/375; 342/372; 342/373

[58] Field of Search ..... 342/375, 372, 373, 81, 342/154, 157

[56] References Cited

U.S. PATENT DOCUMENTS

| | | | |
|---|---|---|---|
| 4,749,995 | 6/1988 | Hopwood et al. | 342/371 |
| 5,107,273 | 4/1992 | Roberts | 342/375 |
| 5,130,717 | 7/1992 | Ewen et al. | 342/375 |
| 5,274,385 | 12/1993 | Riza | 342/375 |

OTHER PUBLICATIONS

"Radar Handbook," Merrill I. Skolnik, Editor in Chief, Naval Research Laboratory, McGraw-Hill Book Company, pp. 11-43 to 11-50, 1970.

"Bandwidth Criteria for Phased Array Antennas," J. Frank, Technology Service Corporation, Phased Array Antennas, Proceedings of the 1970 Phased Array Antenna Symposium, pp. 243-253, Jun. 1970.

"Survey of Time-Delay Beam Steering Techniques," R. Tang, Hughes Aircraft Company Ground Systems, Phased Array Antennas, Proceedings of the 1970 Phased Array Antenna Symposium, pp. 254-260, Jun. 1970.

*Primary Examiner*—Theodore M. Blum
*Attorney, Agent, or Firm*—Walter F. Dawson

[57] ABSTRACT

A phased array antenna having two stages of time steering control that achieve system performance requirements at minimum cost. The first-stage which is traditionally located at the subarray level, is a multi-bit time delay unit that has a sufficient number of bits to meet the system's range resolution requirements. The second-stage located at the radiating element level, is a single-bit time delay unit that meets the system's two-way instantaneous bandwidth requirements. This combination of first-stage and second-stage time steering control minimizes the number of subarrays required to achieve the system performance requirements.

35 Claims, 6 Drawing Sheets

PHASED ARRAY RADAR ANTENNA WITH TWO-STAGE TIME DELAY UNITS

The Government has rights in this invention pursuant to Contract No. DASG60-90-C-0210 awarded by the Department of the Army.

BACKGROUND OF THE INVENTION

This invention relates to a phased array radar antenna and in particular to a two-stage time delay steered architecture whereby a first time delay stage is provided at the subarray level and a second time delay stage is provided at the radiating element level.

The use of time delay units for one-stage time steered subarrays of a phased array antenna is well known in the art and described in the Radar Handbook, M. I. Skolnik, Editor, McGraw-Hill, New York, 1970, Section 11.6. In a paper by J. [rank titled "Bandwidth Criteria for Phased Array Antennas," published in Phased Array Antennas, Oliver and Knittel, Editors, Artech House, Inc., 1972, it states on p. 247 that although a time delay network at each element of an array is prohibitively costly with present microwave techniques, a marked increase in instantaneous bandwidth can be obtained using subarrays with time delay networks by dividing the aperture into subapertures or subarrays and placing a time delay network behind each subarray.

Traditional phased arrays use phase shifters at the element level for antenna beam steering and time delay units (TDU) at the subarray level for high range resolution in wideband modes. However, in certain radar applications there is a need for low two-way (transmit/-receive) attenuation at the instantaneous bandwidth edges for high signal-to-noise ratio (SNR) in order to obtain greater details on radar targets at longer range. Another array may be used instantaneously over a narrow band, but it may be desirable to hop from frequency-to-frequency without resetting the phase shifters. Hence, when using the traditional one-stage subarray time steering, the normal subarray size required for range resolution needs to be reduced to obtain high signal-to-noise (SNR) in wide band and wide scan mode. Consequently, the number of subarray TDUs and their related power combining networks increase. For example, in an array comprising 25,344 elements, 176 subarrays (each subarray having a 6-bit TDU) would be required to meet a range resolution requirement of 15 cm. However, to meet a two-way bandwidth attenuation requirement of 4 dB, the array would require 704 subarrays, each with a 6-bit TDU, and their related power combining networks, but such a system is very expensive.

SUMMARY OF THE INVENTION

It is therefore an object of the present invention to provide two-stage time delay units in a phased array antenna in order to achieve low two-way attenuation at the instantaneous bandwidth edges of a transmitted and received signal.

It is a further object of this invention to minimize the number of subarray time delay units and their related power combining networks used in a phased array antenna in order to reduce the antenna system cost while achieving low two-way attenuation at the instantaneous bandwidth edges and reducing the subarray's grating lobe levels in traditional time steered subarrays.

It is a further object of this invention to provide a phased array radar system having a low two-way (transmit/receive) attenuation at the instantaneous bandwidth edges of a transmitted and received signal by employing two-stage time delay units in the phased array antenna thereby minimizing the number of required subarrays.

The objects are further accomplished by a phased array antenna comprising a plurality of antenna radiating elements for providing a directed beam of electromagnetic energy the radiating elements being arranged in groups to form a plurality of time steered subarrays, means in each of the radiating elements for phase steering the direction of the beam of electromagnetic energy, means in each of the radiating elements coupled to the phase steering means for providing a time delay at each of the elements for a partial compensation to a wavefront of the electromagnetic energy produced by the plurality of time steered subarrays, means coupled to each of the subarrays for collimating the electromagnetic energy of transmit output signals or receive input signals of the radiating elements, means coupled to each of the collimating means for providing a predetermined subarray time delay for optimum range resolution at a predetermined scan angle, and means coupled to each of the subarray time delay means for collimating the electromagnetic energy of the subarray time delay means to and from the phased array antenna. The phase steering means comprises a multi-bit phase shift and the element time delay providing means comprises at least a 1-bit time delay. The subarray time delay means comprises a multi-bit time delay. The collimating means coupled to each of the subarray time delay means comprises a beamformer means. The beamformer means comprises a transmit beamformer means for collimating the electromagnetic energy of the transmit output signals of the subarray time delay means. The beamformer means comprises receive beamformer means for collimating the electromagnetic energy of the receive input signals of the subarray time delay means. The receive beamformer means provides multiple signals for monopulse tracking and multi-beam searching.

The objects are further accomplished by providing a phased array radar system comprising a plurality of antenna radiating elements for providing a directed beam of electromagnetic energy, the radiating elements being arranged in groups to form a plurality of time steered subarrays, means in each of the radiating elements for phase steering the direction of the beam of electromagnetic energy, means in each of the radiating elements coupled to the steering means for providing a time delay at each of the elements for a partial compensation to a wavefront of the electromagnetic energy produced by the plurality of time steered subarrays, means coupled to each of the subarrays for collimating the electromagnetic energy of transmit output signals or receive input signals of the radiating elements, means coupled to each of the collimating means for providing a predetermined subarray time delay for optimum range resolution at a predetermined scan angle, beamformer means coupled to each of the subarray time delay means for collimating the electromagnetic energy of the subarray time delay means to and from the phased array antenna, means coupled to the beamformer means for generating a transmit signal, means coupled to the beamformer means for receiving and processing the collimated electromagnetic energy, and means for generating a signal to the transmit signal generating means and for providing a synthesized signal for the receiving and processing means. The phase steering means comprises a multi-bit phase shift and the element time delay providing means comprises at least a 1-bit time delay. The subarray time delay unit means comprises a multi-bit time delay.

The objects are further accomplished by providing a phased array antenna comprising a plurality of antenna radiating elements for providing a directed beam of electromagnetic energy, the radiating elements being arranged in groups to form a plurality of time steered subarrays, each of the radiating elements comprises a radiator, each of the radiating elements comprises a transmit/receive (T/R) means coupled to the radiator for generating a transmit output signal or a receive input signal, the T/R means comprises a phase shifter means for phase steering the direction of the beam of electromagnetic energy, the T/R means comprises an element time delay unit means coupled to the phase shifter means for providing a minimal time delay for a partial compensation to a wavefront of the electromagnetic energy produced by the plurality of time steered subarrays, the partial compensation increasing the instantaneous bandwidth of the phased array antenna, a plurality of power combiner means for collimating the electromagnetic energy of the transmit output signal or the receive input signal, each one of the power combiner means being coupled to the element time delay unit means of a corresponding one of the subarrays, a plurality of subarray time delay unit means for providing a predetermined time delay at a predetermined scan angle for optimum range resolution, each of the plurality of subarray time delay unit means being coupled to a corresponding one of the plurality of power combiner means, and beamformer means coupled to each of the plurality of subarray time delay unit means for collimating the electromagnetic energy. The element time delay unit means comprises at least a 1-bit time delay. The subarray time delay unit means comprises a multi-bit time delay. The beamformer means comprises a transmit beamformer means for collimating the electromagnetic energy of the transmit output signals of the subarray time delay unit means. The beamformer means comprises receive beamformer means for collimating the electromagnetic energy of the receive input signals of the subarray time delay unit means. The receive beamformer means provides multiple signals for monopulse tracking and multi-beam searching.

The objects are further accomplished by a method of directing a beam of electromagnetic energy in a phased array antenna comprising the steps of providing a directed beam of electromagnetic energy with a plurality of antenna radiating elements, the radiating elements being arranged in groups to form a plurality of time steered subarrays, phase steering the direction of the beam of electromagnetic energy with means in each of the radiating elements, providing a time delay at each of the radiating elements with means coupled to the phase steering means for a partial compensation to a wavefront of the electromagnetic energy produced by the plurality of time steered subarrays, collimating the electromagnetic energy of transmit output signals or receive input signals of the radiating elements with means coupled to each of the subarrays, providing a predetermined subarray time delay for optimum range resolution at a predetermined scan angle with means coupled to each of the collimating means, and collimating the electromagnetic energy of the subarray time delay to and from the phased array antenna with means coupled to each of the subarray time delay means. The step of phase steering the direction of the beam of electromagnetic energy comprises the step of providing a multi-bit phase shift means. The step of providing a time delay with the element time delay providing means comprises the step of providing at least a 1-bit time delay. The step of providing a predetermined time delay with the subarray time delay unit means comprises providing a multi-bit time delay. The step of collimating the electromagnetic energy of the radiating elements with means coupled to each of said subarray time delay means comprises the step of using beamformer means.

The objects are further accomplished by a method of directing a beam of electromagnetic energy in a phased array antenna comprising the steps of providing a plurality of antenna radiating elements, the radiating elements being arranged in groups to form a plurality of time steered subarrays, generating a transmit output signal or a receive input signal in the radiating elements, each of the radiating elements comprising a radiator coupled to a transmit/receive (T/R) means, phase-steering the direction of the beam of electromagnetic energy with phase shifter means in the T/R means, providing a time delay with an element time delay unit means coupled to the phase shifter means in the T/R means for a partial compensation to a wavefront of the beam of electromagnetic energy produced by the plurality of time steered subarrays, the partial compensation increasing the instantaneous bandwidth of the phased array antenna, collimating the electromagnetic energy of the transmit output signal or the receive input signal with a plurality of power combiner means, each one of the power combiner means being coupled to the element time delay unit means of a corresponding one of the subarrays, providing a predetermined time delay at a predetermined scan angle for optimum range resolution with a plurality of subarray time delay unit means, each of the plurality of subarray time delay unit means being coupled to a corresponding one of the plurality of power combiner means, and collimating the electromagnetic energy of said radiating elements to and from the subarray time delay unit means with a beamformer means. The step of phase steering the direction of the beam of electromagnetic energy with phase shifter means comprises the step of providing a multi-bit phase shift. The step of providing a time delay with the element time delay unit means comprises the step of using at least a 1-bit time delay. The step of providing a predetermined time delay with the subarray time delay unit means comprises the step of using a multi-bit time delay. The step of collimating the electromagnetic energy with the beamformer means comprises the step of using a transmit beamformer means for collimating the electromagnetic energy of the transmit output signal of the subarray time delay unit means. The step of collimating the electromagnetic energy with the beamformer means comprises the step of using a receive beamformer means for collimating the electromagnetic energy of the receive input signals of the subarray time delay unit means. The step of collimating the electromagnetic energy with the receive beamformer means provides multiple signals for monopulse tracking and multibeam searching.

DESCRIPTION OF THE PREFERRED EMBODIMENT

Figure 1:
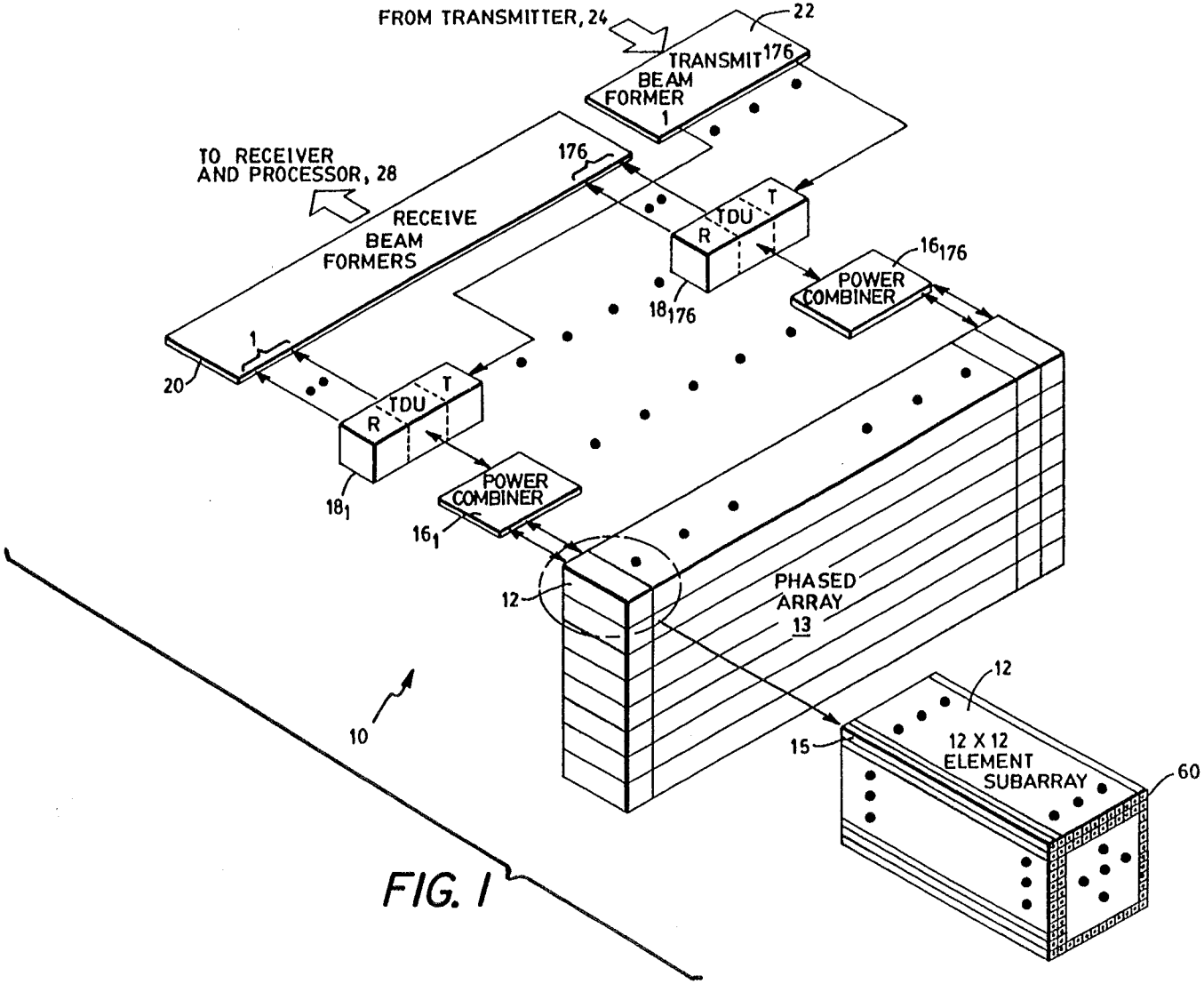
FIG. 1 is a perspective block diagram of a phased array radar antenna which includes the invention.
Figure 2:
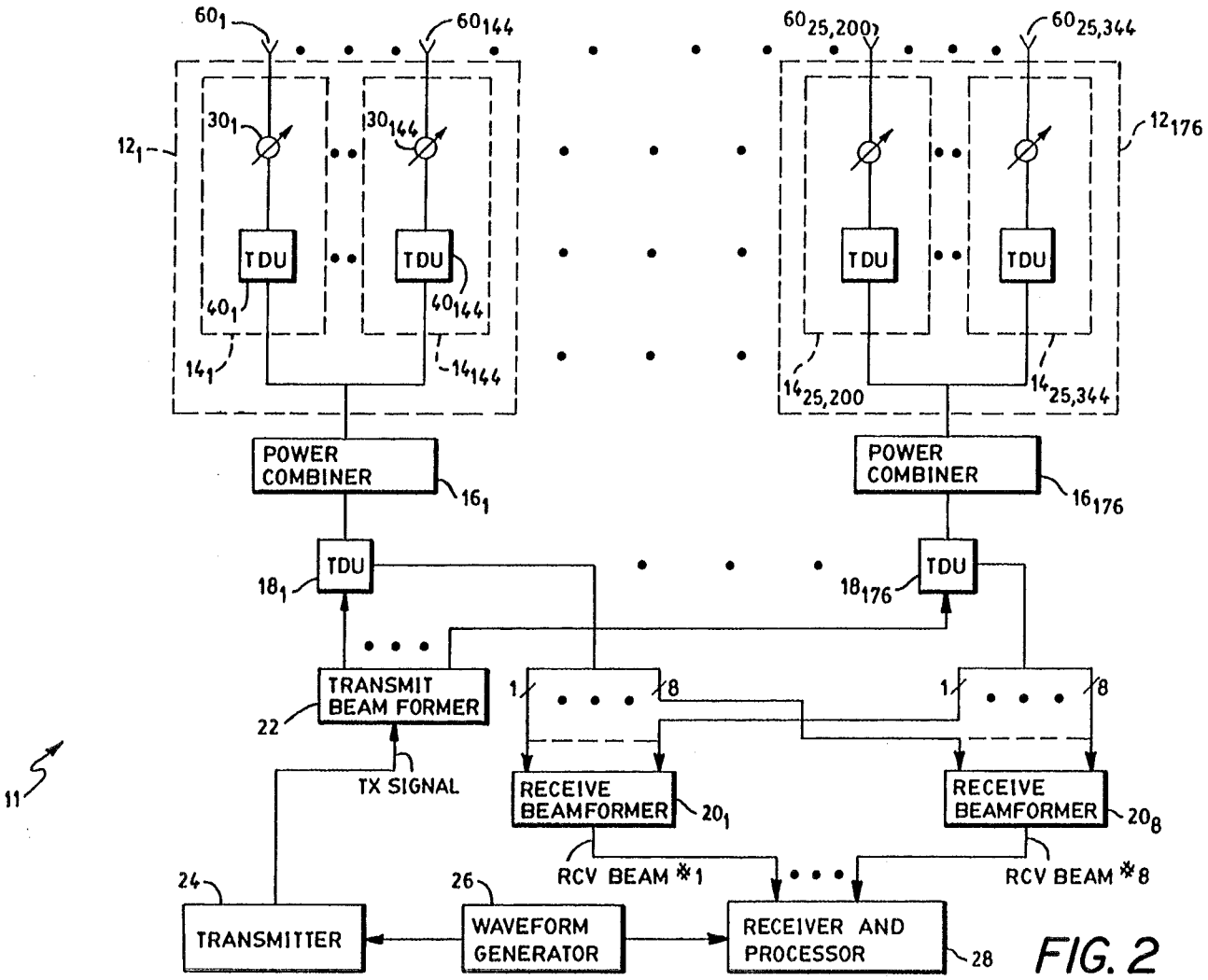
FIG. 2 is a block diagram of a phased array radar system including the invention showing a 1-bit time delay unit in each radiating element path of a phased array and a 6-bit time delay unit at each subarray level.
Figure 3:
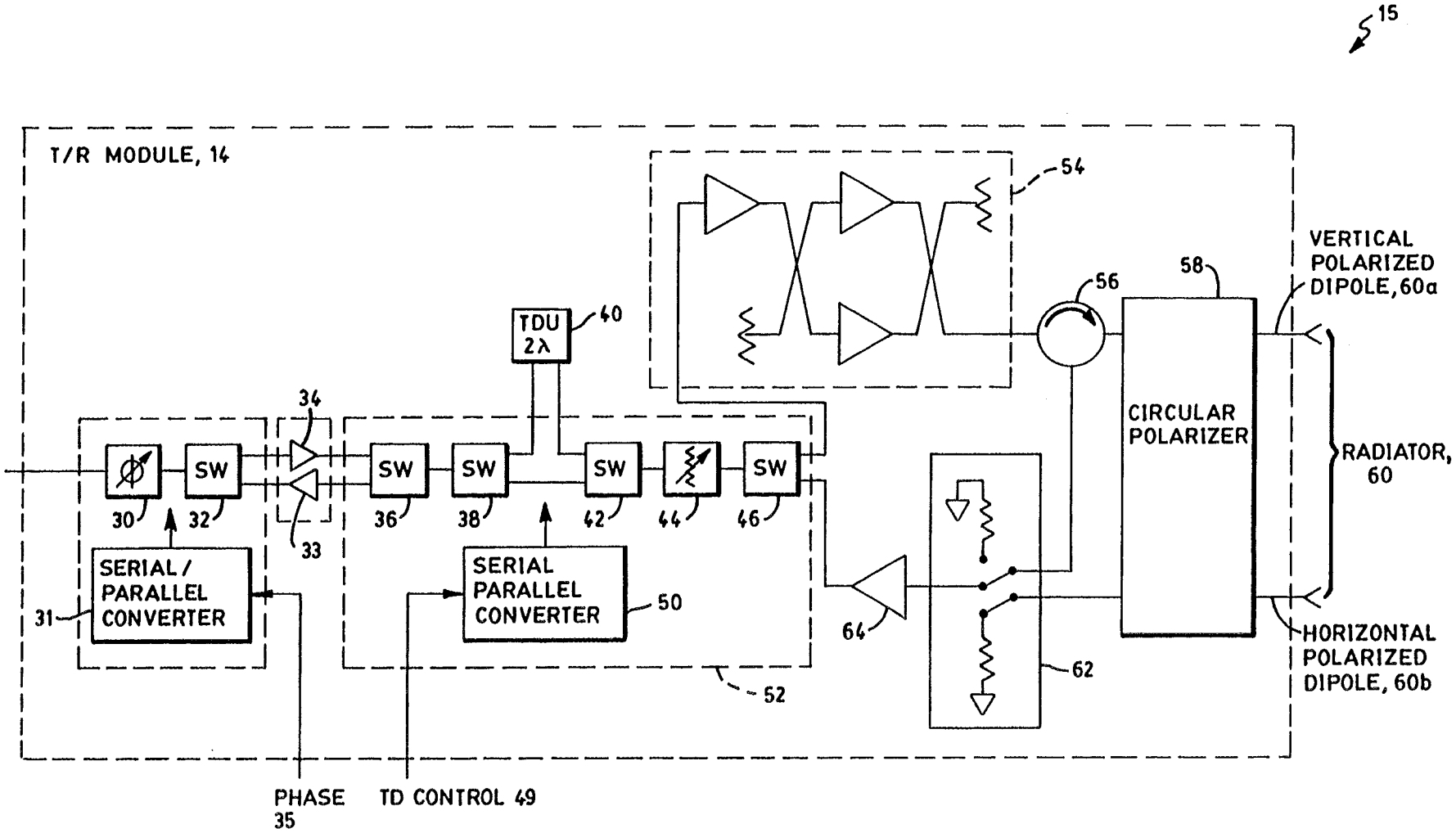
FIG. 3 is a block diagram of a radiating element comprising a T/R module having a 1-bit time delay unit.

Referring to FIG. 1 and FIG. 2, a perspective block diagram is shown in FIG. 1 of a phased array antenna 10 comprising a phased array 13 having a plurality of subarrays $\mathbf{12}_{1\text{-}S}$ (where S=176 in this preferred embodiment) with each subarray comprising a plurality of radiating elements $\mathbf{15}_{1\text{-}E}$ (where E=25,344 in the preferred embodiment). There are 144 radiating elements $\mathbf{15}_{1\text{-}E}$ in each of the subarrays $\mathbf{12}_{1\text{-}S}$. Each of the radiating elements $\mathbf{15}_{1\text{-}E}$ comprises a transmit/receive (T/R) module $\mathbf{14}_{1\text{-}E}$ coupled to a cross-dipole radiator $\mathbf{60}_{1\text{-}E}$ as shown in FIG. 2. Each T/R module $\mathbf{14}_{1\text{-}E}$ comprises a 6 bit phase shifter $\mathbf{30}_{1\text{-}E}$, one-bit time delay unit $\mathbf{40}_{1\text{-}E}$, and other components as shown in FIG. 3 and described hereinafter. A power combiner $\mathbf{16}_{1\text{-}S}$ collimates electromagnetic energy of the radiating elements $\mathbf{15}_{1\text{-}E}$ of each subarray $\mathbf{12}_{1\text{-}S}$ into a 6-bit time delay unit (TDU) $\mathbf{18}_{1\text{-}S}$. Each TDU $\mathbf{18}_{1\text{-}S}$ provides the subarray's time steering control and is coupled to one of 8 receive beamformers $\mathbf{20}_{1\text{-}8}$ used for monopulse track and multi-beam search. A transmit beamformer 22 provides a transmit signal to each TDU $\mathbf{18}_{1\text{-}S}$ for driving each subarray $\mathbf{12}_{1\text{-}S}$.

Referring to FIG. 2, a simplified block diagram of a phased array radar system 11 including the phased array antenna 10 invention is shown comprising element phase shifters $\mathbf{30}_{1\text{-}E}$ and two-stage time delay units $\mathbf{18}_{1\text{-}S}$ and $\mathbf{40}_{1\text{-}E}$. In addition to the phased array antenna 10 described FIG. 1, the transmit beamformer 22 is coupled to a transmitter 24 which provides the transmit signal (TX signal) to the transmit beamformer 22. Receive beamformers $\mathbf{20}_{1\text{-}8}$ have their outputs coupled to a receiver and processor 28 where the eight RCV beam #1–#8 signals are processed. A waveform generator 26 is used to produce the transmit signal from the transmitter 24 for simultaneously providing sufficient electromagnetic energy for detecting targets, for sufficient range resolution of targets and for sufficient rejection of unwanted echos. On receive the waveform generator 26 produces a synthesized signal to compare with a receive signal for discriminating between desired echos and interference of many types for providing the most detectability of a target. The 6-bit element phase shifter $\mathbf{30}_{1\text{-}E}$ is included in each T/R module $\mathbf{14}_{1\text{-}E}$ of each of the radiating elements $\mathbf{15}_{1\text{-}E}$ and provides a phase shift for steering the antenna beam. A phased array 13 that is steered by phase shift, rather than time delay, will scan as the frequency is changed. This fundamental mechanism limits the bandwidth of a phased array antenna 10. The use of the invention of the two-stage TDUs $\mathbf{18}_{1\text{-}S}$ and $\mathbf{40}_{1\text{-}E}$ reduces the array scanning due to frequency change to increase instantaneous bandwidth. The first-stage TDU for each subarray $\mathbf{12}_{1\text{-}S}$ comprises the 6-bit time delay unit $\mathbf{18}_{1\text{-}S}$ which is coupled to a subarray $\mathbf{12}_{1\text{-}S}$ via the power combiner $\mathbf{16}_{1\text{-}S}$ and provides for high range resolution. The first-stage TDU $\mathbf{18}_{1\text{-}S}$ provides a predetermined time delay required by a predetermined scan angle and the size of phased array 13. The second-stage 1-bit time delay unit 40 is included in each T/R module $\mathbf{14}_{1\text{-}E}$ of each radiating element $\mathbf{15}_{1\text{-}E}$ and provides a minimal time delay required to meet, for the preferred embodiment, a 4 dB specification of the two-way attenuation at the instantaneous bandwidth edges (the center frequency being ±1000 MHz) at a maximal scan angle of 38.5°. Since the second-stage TDU $\mathbf{40}_{1\text{-}E}$ inserted in the T/R module $\mathbf{14}_{1\text{-}E}$ produces more insertion loss and weight because of its physical length, a minimal length of each element TDU $\mathbf{40}_{1\text{-}E}$ is selected for a cost-effective design which in the present embodiment is 2 wavelengths (2λ). This length is determined by examining the numerical results of wide band performance of a phased array radar system with various lengths of time delay units. These numerical results are obtained by computer simulation, and such a computer simulation mathematically models the phased array radar system. Such mathematical model of the phased array radar system is known to one of ordinary skill in the art.

Referring now to FIG. 3, a block diagram is shown of a radiating element 15 comprising T/R module 14 and the cross-dipole radiator 60. The T/R module 14 comprises the one-bit time delay unit 40. A phase shifter 30 is coupled to a switch 32 both of which are controlled by a serial/parallel converter 33. Pre-post amplifiers 33, 34 are coupled between switches 32 and 36. Pre-amplifier 34 is selected by switches 32 and 36 when the T/R module 14 is in the transmit mode, and post-amplifier 33 is selected by switches 32 and 36 in the receive mode. Switch 36 is coupled to switch 38. The one-bit time delay unit 40 which provides two wavelengths of delay is connected between switches 38 and 42 so that it can be switched in or out of the circuit in accordance with control signals from a serial-parallel converter 50. Switch 42 is coupled to a variable attenuator 44 which is coupled to switch 46. The variable attenuator 44 adjusts amplitude of electromagnetic energy in each radiating element for antenna sidelobe control. Switch 46 is used to select a receive signal from a low noise amplifier 64 or to provide a transmit signal to power amplifier 54. Switches 36, 38, 42, 46 and variable attenuator 44 are controlled by the serial/parallel converter 50. The power amplifier 54 is coupled between switch 46 and a circulator 56. The circulator 56 is coupled to a circular polarizer 58 for providing a vertical polarized signal to dipole **60*a* and a horizontal polarized signal to dipole 60*b*. The combination of dipole 60*a* and dipole 60*b* form the cross-dipole radiator 60 for generating circular polarized electromagnetic energy. Switch 62 is coupled between the circulator 56, the polarizer 58 and the low noise amplifier 64 for providing a receive signal to the low noise amplifier 64 when the T/R module 14 is in the receive mode. The above elements of the T/R module 14 and their operation are known to one of ordinary skill in the art. The T/R module 14** is implemented using microelectronic hybrid assembly techniques using active GaAs and digital components known to one of ordinary skill in the art.

Figure 4:
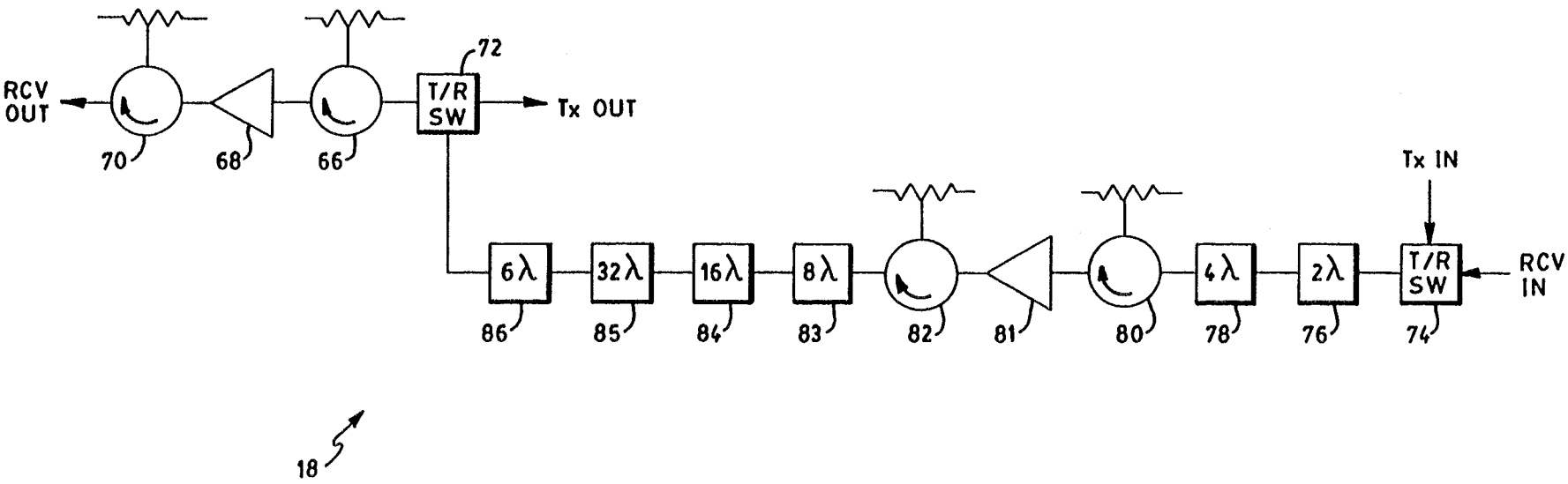
FIG. 4 is a block diagram of a 6-bit time delay unit of a subarray.

Referring now to FIG. 4, a block diagram is shown of a 6-bit time delay unit 18 of a subarray generally known to one of ordinary skill in the art. The 6-bit time delay unit 18 is a four port device comprising switched delay lines 76, 78, 83, 84, 85, 86 and distributed gain sections 66, 68, 70 and 80, 81, 82. A T/R switch (SW) 74 of the 6-bit time delay unit 18 receives a transmit signal (TXIN) or a receive signal (RCVIN) depending on the current mode of operation of the phased array antenna 10 and such signal is coupled to a first time delay component (2λ) 76. The output of the 2λtime delay component 76 is coupled to a second time delay component (4λ) 78 and its output is coupled to an isolator 80. The output of isolator 80 is coupled to an amplifier 81 and the output of amplifier 81 is fed through four more time delay components comprising 8λ83, 16λ84, 32λ85 and 64λ86. The signal from 64λ 86 is fed to a T/R switch 72 which provides an output signal (TXOUT) if the antenna system 10 is in the transmit mode or if in the received mode, the T/R switch 72 couples the signal to isolator 66 which is coupled to amplifier 68, and the output of amplifier 68 is coupled to isolator 70 which provides a receive signal (RCVOUT).

Figure 5:
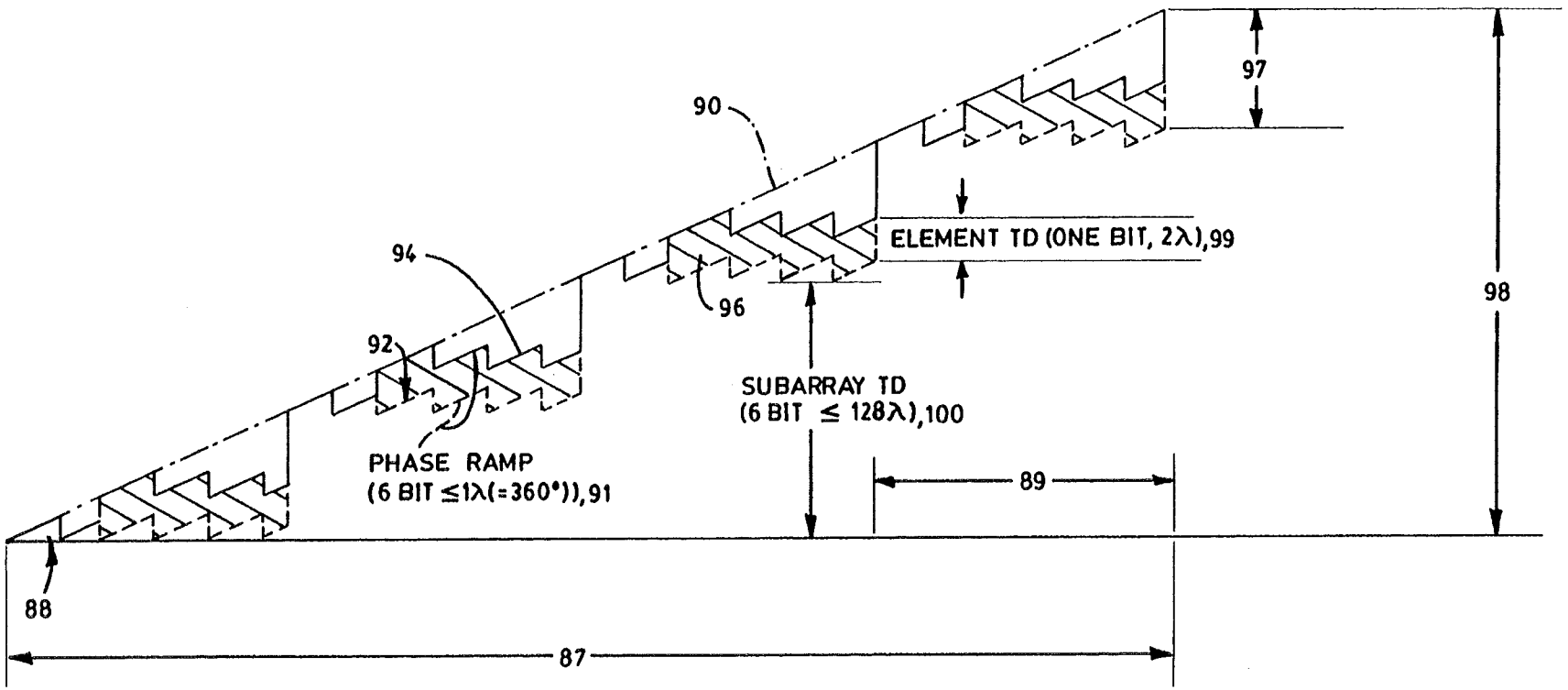
FIG. 5 is a diagram of a time steering wavefront showing an ideal equal time steering wavefront, a one-stage subarray time steering wavefront and a two-stage time steering wavefront.

Referring now to FIG. 5, a diagram of an ideal equal time steering wavefront 90 is shown along with a one-stage subarray time steering wavefront 92 (6-bit, 128λ) and a two-stage time steering wavefront 94 for ease of comparison. In this diagram, a phase ramp 91 of less than one wavelength (360 degrees in phase) is provided by element phase shifters 30. A small step of two-wavelength time delays within a subarray is provided by 1-bit element TDUs $\mathbf{40}_{1\text{-}E}$, and a large step of several wavelength time delays from subarray to subarray is provided by 6-bit subarray TDUs $\mathbf{18}_{1\text{-}S}$(only four subarrays are illustrated in FIG. 5). The cross-hatched area shows the partial compensation to a one-stage subarray time steering wavefront 92 accomplished by having a 1-bit time delay unit of T/R module $\mathbf{14}_{1\text{-}E}$ at each radiating element $\mathbf{15}_{1\text{-}E}$ of a phased array antenna 10. Compared to a one-stage subarray time steering wavefront 92, the two-way attenuation at the instantaneous bandwidth edges decreases and the subarray's grating lobe levels are reduced for the preferred embodiment employing the two-stage time steering wavefront 94. Additional compensation to the wavefront can be obtained by adding more bits to the time delay units $\mathbf{40}_{1\text{-}E}$ of the T/R module $\mathbf{14}_{1\text{-}E}$ at each radiating element $\mathbf{15}_{1\text{-}E}$. The maximum time delay 97 for the element time delay unit $\mathbf{40}_{1\text{-}E}$ is determined by $D \sin \theta_S / N_{SA}$ where D is the array dimension 87. $\theta_S$ is the array scan angle 99 and $N_{SA}$ is the number of subarrays. $D/N_{SA}$ is the subarray dimension 89. The maximum time delay 98 for the subarray time delay unit $\mathbf{18}_{1\text{-}S}$ is determined by $D \sin \theta_S$.

Figure 6:
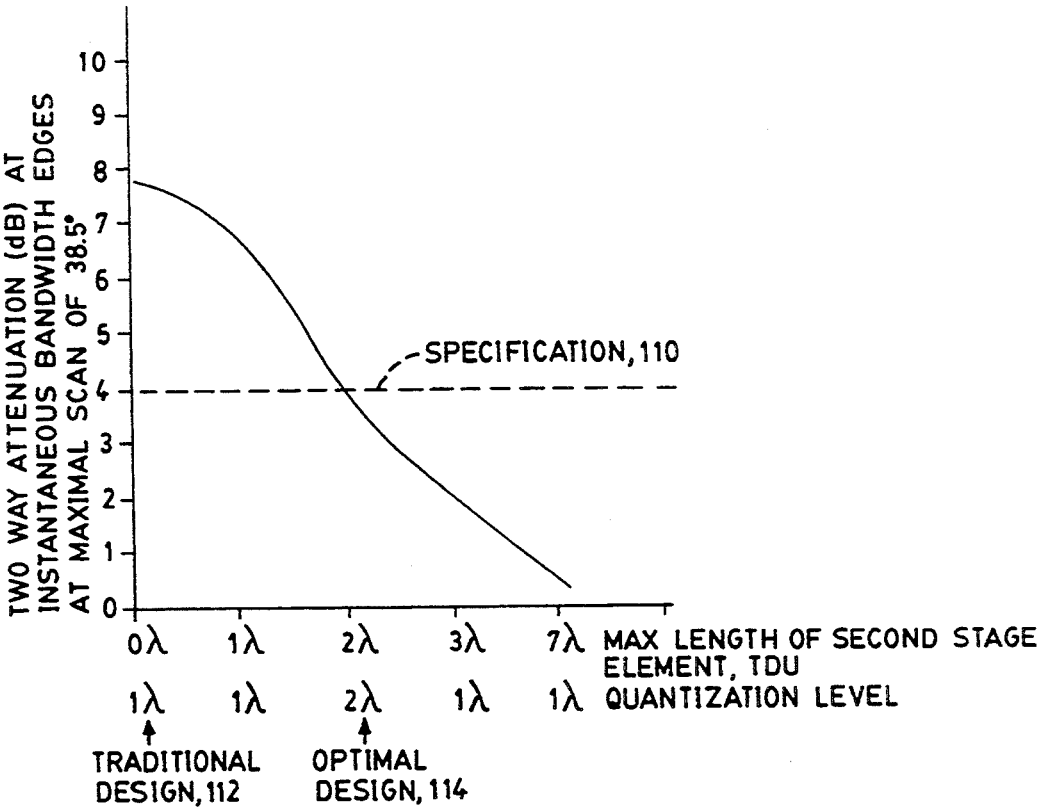
FIG. 6 is a graph of the two-way attenuation (dB) at the instantaneous bandwidth edges at a maximal scan angle of 38.5° versus the maximum length of an element TDU showing an optimal time delay of 2λ (two wavelengths) in accordance with a 4 dB specification of two-way attenuation at the instantaneous bandwidth edges.

Referring now to FIG. 6, a graph is shown of the two-way attenuation (dB) at instantaneous bandwidth edges (the center frequency being ±1000 MHz) versus a maximum length of an element TDU 40 at the maximal scan of 38.5°. In order to achieve the 4 dB two-way attenuation specification 770, the optimal design 774 for the element TDU $\mathbf{40}_{1\text{-}E}$ is 2λ. The data for the plotted curve results from a computer simulation of a phased array radar system wherein the mathematically modeling of any such system may be accomplished by one of ordinary skill in the art.

Figure 7:
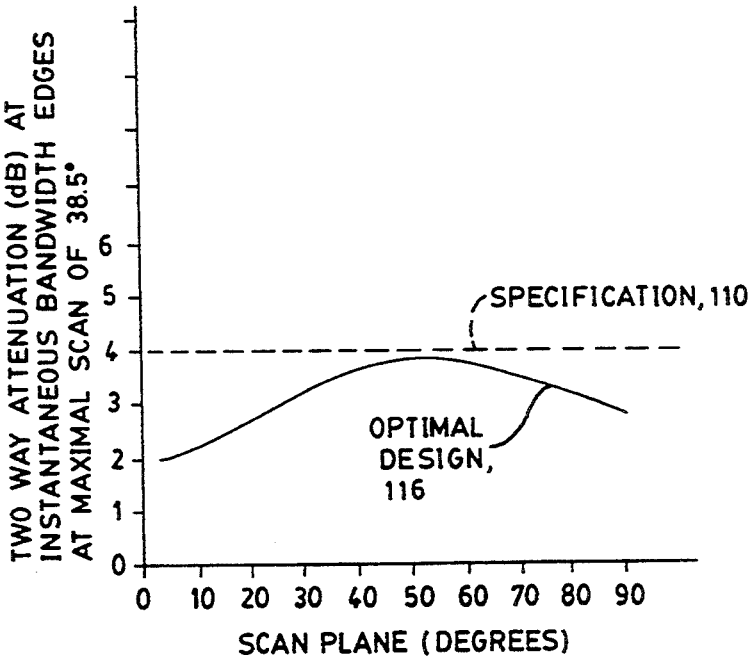
FIG. 7 is a graph of the two-way attenuation (dB) at the instantaneous bandwidth edges for the maximal scan angle of 38.5° versus the scan plane (degrees) showing the wideband performance of the phased array antenna using a one-bit element time delay unit.

Referring now to FIG. 7, a graph is shown of the two-way attenuation (dB) at instantaneous bandwidth edges (the center frequency being ±1000 MHz) versus the scan plane (degrees). FIG. 7 shows that the two-way attenuation at the instantaneous bandwidth edges meets the 4 dB antenna specification 770 of the preferred embodiment for all scan planes at the predetermined maximal scan angle of 38.5° for the phased array antenna 10 using a 1-bit TDU $\mathbf{40}_{1\text{-}E}$ at each radiating element $\mathbf{15}_{1\text{-}E}$ with minimal number of subarray time steering controls.

This concludes the description of the preferred embodiment. However, many modifications and alterations will be obvious to one of ordinary skill in the art without departing from the spirit and scope of the inventive concept. Therefore, it is intended that the scope of this invention be limited only by the appended claims.

What is claimed is:

1. A phased array antenna comprising:

a plurality of antenna radiating elements for providing a directed beam of electromagnetic energy said radiating elements being arranged in groups to form a plurality of time steered subarrays;

means in each of said radiating elements for phase steering the direction of said beam of electromagnetic energy; means in each of said radiating elements coupled to said phase steering means for providing a time delay at each of said elements for a partial compensation to a wavefront of said electromagnetic energy produced by said plurality of time steered subarrays;

means coupled to each of said subarrays for collimating said electromagnetic energy of transmit output signals or receive input signals of said radiating elements;

means coupled to each of said collimating means for providing a predetermined subarray time delay for optimum range resolution at a predetermined scan angle; and means coupled to each of said subarray time delay means for collimating said electromagnetic energy of said subarray time delay means to and from said phased array antenna.

2. The phased array antenna as recited in claim 1 wherein said phase steering means comprises a multi-bit phase shift and said element time delay providing means comprises at least a 1-bit time delay.

3. The phased array antenna as recited in claim 1 wherein said subarray time delay means comprises a multi-bit time delay.

4. The phased array antenna as recited in claim 1 wherein said collimating means coupled to each of said subarray time delay means comprises a beamformer means.

5. The phased array antenna as recited in claim 4 wherein said beamformer means comprises a transmit beamformer means for collimating said electromagnetic energy of said transmit output signals of said subarray time delay means.

6. The phased array antenna as recited in claim 4 wherein said beamformer means comprises receive beamformer means for collimating said electromagnetic energy of said receive input signals of said subarray time delay means.

7. The phased array antenna as recited in claim 6 wherein said receive beamformer means provides multiple signals for monopulse tracking and multi-beam searching.

8. A phased array radar system comprising:

a plurality of antenna radiating elements for providing a directed beam of electromagnetic energy, said radiating elements being arranged in groups to form a plurality of time steered subarrays;

means in each of said radiating elements for phase steering the direction of said beam of electromagnetic energy;

means in each of said radiating elements coupled to said steering means for providing a time delay at each of said elements for a partial compensation to a wavefront of said electromagnetic energy produced by said plurality of time steered subarrays;

means coupled to each of said subarrays for collimating said electromagnetic energy of transmit output signals or receive input signals of said radiating elements;

means coupled to each of said collimating means for providing a predetermined subarray time delay for optimum range resolution at a predetermined scan angle;

beamformer means coupled to each of said subarray time delay means for collimating said electromagnetic energy of said subarray time delay means to and from said phased array antenna;

means coupled to said beamformer means for generating a transmit signal;

means coupled to said beamformer means for receiving and processing said collimated electromagnetic energy; and means for generating a signal to said transmit signal generating means and for providing a synthesized signal for said receiving and processing means.

9. The phased array radar system as recited in claim 8 wherein said phase steering means comprises a multi-bit phase shift and said element time delay providing means comprises at least a 1-bit time delay.

10. The phased array radar system as recited in claim 8 wherein said subarray time delay unit means comprises a multi-bit time delay.

11. The phased array radar system as recited in claim 8 wherein said collimating means coupled to each of said subarray time delay means comprises a beamformer means.

12. The phased array radar system as recited in claim 11 wherein said beamformer means comprises a transmit beamformer means for collimating said electromagnetic energy of said transmit output signals of said subarray time delay means.

13. The phased array radar system as recited in claim 11 wherein said beamformer means comprises receive beamformer means for collimating said electromagnetic energy of said receive input signals of said subarray time delay means.

14. The phased array radar system as recited in claim 13 wherein said receive beamformer means provides multiple signals for monopulse tracking and multi-beam searching.

15. A phased array antenna comprising:

a plurality of antenna radiating elements for providing a directed beam of electromagnetic energy, said radiating elements being arranged in groups to form a plurality of time steered subarrays;

each of said radiating elements comprises a radiator;

each of said radiating elements comprises a transmit/-receive (T/R) means coupled to said radiator for generating a transmit output signal or a receive input signal;

said T/R means comprises a phase shifter means for phase steering the direction of said beam of electromagnetic energy;

said T/R means comprises an element time delay unit means coupled to said phase shifter means for providing a minimal time delay for a partial compensation to a wavefront of said electromagnetic energy produced by said plurality of time steered subarrays, said partial compensation increasing the instantaneous bandwidth of said phased array antenna;

a plurality of power combiner means for collimating the electromagnetic energy of said transmit output signal or said receive input signal, each one of said power combiner means being coupled to said element time delay unit means of a corresponding one of said subarrays;

a plurality of subarray time delay unit means for providing a predetermined time delay at a predetermined scan angle for optimum range resolution, each of said plurality of subarray time delay unit means being coupled to a corresponding one of said plurality of power combiner means; and beamformer means coupled to each of said plurality of subarray time delay unit means for collimating said electromagnetic energy.

16. The phased array antenna as recited in claim 15 wherein said phase shifter means comprises a multi-bit phase shift and said element time delay providing means comprises at least a 1-bit time delay.

17. The phased array antenna as recited in claim 15 wherein said subarray time delay unit means comprises a multi-bit time delay.

18. The phased array antenna as recited in claim 15 wherein said beamformer means comprises a transmit beamformer means for collimating said electromagnetic energy of said transmit output signals of said subarray time delay unit means.

19. The phased array antenna as recited in claim 15 wherein said beamformer means comprises receive beamformer means for collimating said electromagnetic energy of said receive input signals of said subarray time delay unit means.

20. The phased array antenna as recited in claim 19 wherein said receive beamformer means provides multiple signals for monopulse tracking and multi-beam searching.

21. A method of directing a beam of electromagnetic energy in a phased array antenna comprising the steps of: providing a directed beam of electromagnetic energy with a plurality of antenna radiating elements, said radiating elements being arranged in groups to form a plurality of time steered subarrays; phase steering the direction of said beam of electromagnetic energy with means in each of said radiating elements;

providing a time delay at each of said radiating elements with means coupled to said phase steering means for a partial compensation to a wavefront of said electromagnetic energy produced by said plurality of time steered subarrays;

collimating said electromagnetic energy of transmit output signals or receive input signals of said radiating elements with means coupled to each of said subarrays;

providing a predetermined subarray time delay for optimum range resolution at a predetermined scan angle with means coupled to each of said collimating means; and collimating said electromagnetic energy of said subarray time delay to and from said phased array antenna with means coupled to each of said subarray time delay means.

22. The method as recited in claim 21 wherein said step of phase steering the direction of said beam of electromagnetic energy comprises the step of providing a multi-bit phase shift means.

23. The method as recited in claim 21 wherein said step of providing a time delay with said element time delay providing means comprises the step of providing at least a 1-bit time delay.

24. The method as recited in claim 21 wherein said step of providing a predetermined time delay with said subarray time delay unit means comprises providing a multibit time delay.

25. The method as recited in claim 21 wherein said step of collimating said electromagnetic energy of said radiating elements with means coupled to each of said subarray time delay means comprises the step of using beamformer means.

26. The method as recited in claim 25 wherein said step of using said beamformer means comprises the step of using a transmit beamformer means for collimating said electromagnetic energy of said transmit output signals of said subarray time delay means.

27. The method as recited in claim 25 wherein said step of using said beamformer means comprises the step of using receive beamformer means for collimating said electromagnetic energy of said receive input signals of said subarray time delay means.

28. The method as recited in claim 27 wherein said step of collimating said electromagnetic energy with receive beamformer means provides multiple signals for monopulse tracking and multiple beams for searching.

29. A method of directing a beam of electromagnetic energy in a phased array antenna comprising the steps of:

providing a plurality of antenna radiating elements, said radiating elements being arranged in groups to form a plurality of time steered subarrays;

generating a transmit output signal or a receive input signal in said radiating elements, each of said radiating 8 elements comprising a radiator coupled to a transmit/receive (T/R) means;

phase-steering the direction of said beam of electromagnetic energy with phase shifter means in said T/R means;

providing a time delay with an element time delay unit means coupled to said phase shifter means in said T/R means for a partial compensation to a wavefront of said electromagnetic energy produced by said plurality of time-steered subarrays, said partial compensation increasing the instantaneous bandwidth of said phased array antenna;

collimating the electromagnetic energy of said transmit output signal or said receive input signal with a plurality of power combiner means, each one of said power combiner means being coupled to said element time delay unit means of a corresponding one of said subarrays;

providing a predetermined time delay at a predetermined scan angle for optimum range resolution with a plurality of subarray time delay unit means, each of said plurality of subarray time delay unit means being coupled to a corresponding one of said plurality of power combiner means; and collimating said electromagnetic energy of said radiating elements to and from said subarray time delay unit means with a beamformer means.

30. The method as recited in claim 29 wherein said step of phase steering the direction of said beam of electromagnetic energy with phase shifter means comprises the step of providing a multi-bit phase shift.

31. The method as recited in claim 29 wherein said step of providing a time delay with said element time delay unit means comprises the step of using at least a 1-bit time delay.

32. The method as recited in claim 29 wherein said step of providing a predetermined time delay with said subarray time delay unit means comprises the step of using a multi-bit time delay.

33. The method as recited in claim 29 wherein said step of collimating said electromagnetic energy with said beamformer means comprises the step of using a transmit beamformer means for collimating said electromagnetic energy of said transmit output signals of said subarray time delay unit means.

34. The method as recited in claim 29 wherein said step of collimating said electromagnetic energy with said beamformer means comprises the step of using a receive beamformer means for collimating said electromagnetic energy of said receive input signals of said subarray time delay unit means.

35. The method as recited in claim 34 wherein said step of collimating said electromagnetic energy with said receive beamformer means provides multiple signals for monopulse tracking and multi-beam searching.

* * * * *